US012674293B2

(12) United States Patent
Boontjes

(10) Patent No.: US 12,674,293 B2
(45) Date of Patent: Jul. 7, 2026

(54) HEAVE TOLERANT PILE GUIDING DEVICE FOR GUIDING A PILE DURING INSTALLATION THEREOF

(71) Applicant: Itrec B.V., Schiedam (NL)

(72) Inventor: Lucas Boontjes, Schiedam (NL)

(73) Assignee: ITREC B.V., Schiedam (NL)

( * ) Notice: Subject to any disclaimer, the term of this patent is extended or adjusted under 35 U.S.C. 154(b) by 2 days.

(21) Appl. No.: 18/712,433

(22) PCT Filed: Dec. 1, 2022

(86) PCT No.: PCT/EP2022/083985

§ 371 (c)(1),
(2) Date: May 22, 2024

(87) PCT Pub. No.: WO2023/110420

PCT Pub. Date: Jun. 22, 2023

(65) Prior Publication Data

US 2025/0012032 A1 Jan. 9, 2025

(30) Foreign Application Priority Data

Dec. 17, 2021 (NL) ..... 2030175

(51) Int. Cl.
*E02D 13/04* (2006.01)
*B63B 75/00* (2020.01)
(Continued)

(52) U.S. Cl.
CPC ..... *E02D 13/04* (2013.01); *B63B 75/00* (2020.01); *E02B 2017/0039* (2013.01); *E02D 7/06* (2013.01)

(58) Field of Classification Search
CPC ..... E02D 13/04; E02B 2017/0065; E02B 2017/0039; E02B 2017/0091; B63B 75/00
See application file for complete search history.

(56) References Cited

U.S. PATENT DOCUMENTS

2021/0123203 A1* 4/2021 Rabaut ..... E02D 7/00

FOREIGN PATENT DOCUMENTS

GB 2 434 823 A 8/2007
WO WO 2018/117846 A1 6/2018
(Continued)

OTHER PUBLICATIONS

Dutch Search Report, issued in Priority Application No. 2030175, dated Jul. 19, 2022.
(Continued)

*Primary Examiner* — Sean D Andrish
(74) *Attorney, Agent, or Firm* — Birch, Stewart, Kolasch & Birch, LLP

(57) ABSTRACT

A heave tolerant pile guiding device for guiding a pile including a cylindrical section and above said cylindrical section a tapered section that narrows in upward direction. The device includes a frame to be mounted to a vessel having a hull subject to sea-state induced motion during installation of a pile. At least one pair of first and second pile engaging devices is arranged on the frame diametrically opposed relative to a center axis. Each pile engaging device comprises a pile engaging member and a hydraulic cylinder to move the member radially relative to the center axis. A hydraulic system includes a position control circuit and a sphincter control circuit. The sphincter control circuit is configured to operate the pair of first and second hydraulic cylinders in particular when the pile engaging members engage on the tapered section of the pile. The sphincter control circuit is a rotary flow divider.

8 Claims, 3 Drawing Sheets

(51) Int. Cl.
*E02B 17/00* (2006.01)
*E02D 7/06* (2006.01)

(56) References Cited

FOREIGN PATENT DOCUMENTS

| | | | |
|---|---|---|---|
| WO | WO 2019/125172 | A2 | 6/2019 |
| WO | WO 2019/125172 | A3 | 10/2019 |
| WO | WO 2021/058544 | A1 | 4/2021 |

OTHER PUBLICATIONS

International Search Report, issued in PCT/EP2022/083985, dated Mar. 30, 2023.
Written Opinion of the International Searching Authority, issued in PCT/EP2022/083985, dated Mar. 30, 2023.

* cited by examiner

HEAVE TOLERANT PILE GUIDING DEVICE FOR GUIDING A PILE DURING INSTALLATION THEREOF

BACKGROUND OF THE INVENTION

The invention relates to a pile guiding device for guiding a pile, e.g. a monopile, during installation thereof in the seabed. The pile guiding device is configured to be mounted to a vessel.

In the field of offshore wind energy, many wind turbines are mounted on a foundation that is formed by a monopile. This monopile is driven into the seabed and then the wind turbine is installed on the monopile. These monopiles are very large and heavy. A monopile may have a length of 100 meters or more, a greatest diameter of 10 meters or more, and a weight of more than 1000 mt, possibly even more than 2000 mt.

In known embodiments, the monopile is not of uniform cylindrical cross-section over its length. These monopiles often have a lower cylindrical section, of which a portion is to be driven into the seabed, and above the lower cylindrical section a tapered section that narrows in upward direction, often with a second cylindrical section adjoining the narrower top of the tapered section of the pile.

For the installation of monopiles both jack-up vessels as well as floating installation vessels are employed. An advantage of a jack-up vessel is that—when extended—the jack-up legs provide stability to the hull so that the pile guiding device is not subject to heave motion. A drawback of a jack-up vessel is that extension and retraction of the legs is time-consuming and may be hampered by local soil conditions. Therefore, it is also known to install monopiles using a floating vessel, wherein the pile guiding device is mounted to the hull, which is subject to sea state induced motion, including heave motion, during pile installation.

Even with the enormous size and weight of the monopile, stringent requirements are associated with the installation thereof. For example, the monopile should often be installed with an accuracy of verticality in the order of 0.25° from vertical. This requirement translates into high demands on the effectiveness of the pile guiding device to keep the monopile vertical during the installation, e.g. during landing and during the subsequent pile driving activity.

In known embodiments, the pile guiding device for guiding a pile, e.g. a monopile, comprises:

- a frame configured to be mounted to a vessel having a hull subject to sea-state induced motion during installation of a pile,
- at least one pair of first and second pile engaging devices which are arranged on the frame diametrically opposed relative to a center axis,
- wherein each pile engaging device comprises a pile engaging member configured to engage on an exterior of the pile during installation thereof, e.g. a roller, and a hydraulic cylinder configured to move the pile engaging member radially relative to the center axis. Herein, each of the cylinders has a cylinder body with a head and a bottom, a piston rod and piston rod assembly, the piston protruding from the head of the cylinder body, a variable volume bottom chamber between the bottom and the piston, a variable volume head chamber between the head and the piston,
- a hydraulic circuit associated with the pair of first and second hydraulic cylinders.

In known embodiments, the hydraulic system comprises a position control circuit that is configured to operate the pair of first and second hydraulic cylinders on the basis of position control when the pile engaging members engage on the cylindrical section of the pile. Through appropriate design and operation of the position control circuit, the pile can be kept with its longitudinal axis on the center axis in order to keep the pile in its desired vertical orientation. An example of such a device is shown in WO2019/125172.

When the pile installation is done with a floating vessel on which the pile guiding device is arranged, it is known to provide the pile guiding device with a motion compensating support assembly. In known embodiments, this assembly supports the frame of the pile guiding device relative to the hull of the vessel in a manner that allows for compensation of vessel motion in a horizontal plane. For example, an X-Y motion compensating support assembly is disclosed in WO2019/125172.

SUMMARY OF THE INVENTION

The invention aims to provide an improved pile guiding device. In particular, the invention aims to provide a pile guiding device that is more effective in guiding of a pile, e.g. a monopile, that has a lower cylindrical section, of which a portion is to be driven into the seabed, and above that lower cylindrical section a tapered section that narrows in upward direction, e.g. with a second or upper cylindrical section adjoining the narrower top of the tapered section.

The invention provides a heave tolerant pile guiding device for guiding a pile during installation thereof, the pile comprising a cylindrical section and above said cylindrical section a tapered section that narrows in upward direction, which pile guiding device comprises:

- a frame configured to be mounted to a vessel having a hull that is subject to sea-state induced motion during installation of a pile,
- at least one pair of first and second pile engaging devices which are arranged on the frame diametrically opposed relative to a center axis,
- wherein the first pile engaging device comprises a first pile engaging member that is configured to engage on an exterior of the pile during installation thereof, and a first hydraulic cylinder configured to move the first pile engaging member radially relative to the center axis, and wherein the second pile engaging device comprises a second pile engaging member that is configured to engage on the exterior of the pile during installation thereof, and a second hydraulic cylinder configured to move the second pile engaging member radially relative to the center axis,
- a hydraulic circuit associated with the pair of first and second hydraulic cylinders,
- wherein the hydraulic system comprises a position control circuit that is configured to operate the pair of first and second hydraulic cylinders on the basis of position control.

The hydraulic system comprises, in addition to a position control circuit which is also found in prior art pile guiding device, a sphincter control circuit.

The additional sphincter control circuit is configured to operate the pair of first and second hydraulic cylinders in particular when the pile engaging members engage on the tapered section of the pile.

The sphincter control circuit comprises:

- a first line connected to the bottom chamber of the first cylinder,
- a second line connected to the bottom chamber of the second cylinder a third line connected to the both the head chamber of the first cylinder and the head chamber of the second cylinder, a rotary flow divider having a first pump device and a second pump device on a common rotary shaft, the first pump device connected to the first line and the second pump device connected to the second line, each of the pump devices being connected to the third line, an accumulator connected to the third line, a valve assembly configured to selectively open and close the connection of the rotary flow divider to the first and second lines.

When the cylindrical section of the pile is guided by the pile guiding device, the sphincter control circuit may be disabled as the valve assembly is the operated to close the connection of the rotary flow divider to the first and second lines. The hydraulic cylinders are then operated by the position control circuit, basically in the manner known in the art, e.g. to center the pile on the center axis.

In particular when the tapered section of the pile is to be guided by the pile guiding device, the valve assembly is operated so that the sphincter circuit is enabled and a sphincter mode of the hydraulic cylinders is established. In this mode, the first and second hydraulic cylinders are hydraulically pressurized by the accumulator of the sphincter circuit, thereby urging the pile engaging members against the tapered section pile. For example, the accumulator provides a hydraulic pressure of more than 100 bars, e.g. over 200 bars, to pressurize the cylinders. As a result, the tapered section is continuously forcibly squeezed by the pile engaging devices.

In the sphincter mode vertical heave motion of the pile guiding device relative to the tapered section is accommodated, which heave motion is—in practice—caused by heave motion of the floating hull due to waves.

In more detail, during a downward motion of the pile guiding device relative to the tapered section of the pile, the tapered section as it were forces the pile engaging devices away from one another, which moves the piston inwards and causes the cylinder bottom chambers to expel hydraulic liquid via the first and second lines, respectively. The rotary flow divider now acts to cause an equal flow via the first and second lines of this expelled hydraulic fluid, so that the pile engaging members move symmetrically relative to the center axis. Some of the expelled hydraulic liquid is now fed via the third line to the head chambers of the cylinders, which have a smaller effective cross-section than the bottom chambers due to the presence of the piston rod, and some is received by the accumulator of the sphincter circuit.

During an upward motion of the pile guiding device relative to the tapered section of the pile, the tapered section as it were moves out from between the pile engaging devices. However, the continuous hydraulic pressurization of the cylinders by the accumulator keeps the pile engaging members forcibly in contact with the tapered section. Herein, the accumulator feeds hydraulic liquid via the flow divider to the bottom chambers of the cylinders, the flow divider causing an equal flow of said feeds of hydraulic fluid to the cylinders, which assures that the pile engaging members move symmetrically relative to the center axis. The head chambers expel hydraulic liquid via said third line.

As the pile may have been centered by suitable operation of the position control during the passage of the cylindrical section through the pile guiding device, the continued symmetrical motion of the pile engaging devices in the sphincter mode assures that the centered position of the pile is maintained.

The sphincter circuit and associated sphincter mode of operation of the pile guiding device is considered superior over reliance on position control when passing the tapered section through the pile guiding device, e.g. as such control in this phase would require very large alternating flows in the position control circuit and associated operation of a pump that feeds the position control circuit. The sphincter circuit and associated sphincter control mode may also be used simultaneous with the operation of the position control circuit and associated mode, e.g. during passage of a cylindrical section of the pile through the pile guiding device.

In order to enhance operation and accuracy of the symmetrical motion in the sphincter mode, in an embodiment, the sphincter circuit comprises a flow divider with an integrated hydromotor driving the rotary shaft, wherein the hydromotor is arranged in the connection between the accumulator and the third line, so that during downward motion of the pile guiding device relative to the tapered section of the pile, the expelled hydraulic liquid flowing to the accumulator operates the hydromotor and thereby drives the first and second pumps of the flow divider to cause equal flow, and so that, during upward motion of the pile guiding device relative to the tapered section of the pile, hydraulic liquid is fed from the accumulator via the hydromotor to flow divider and then in equal flows to the bottom chambers, the hydromotor driving the first and second pumps of the flow divider to cause equal flow.

In embodiments, the pump devices of the flow divider are gear pumps. In another embodiment, the pump devices of the flow divider are piston pumps, e.g. radial piston pumps.

In order to avoid cavitation of the pumps of the rotary flow divider, preferably, the sphincter circuit comprises a boost accumulator connected to the third line between the flow divider and the hydromotor. This boost accumulator may be set at a significant lower pressure than the main accumulator, e.g. at 20 bars.

In practical embodiments, each pile engaging device comprises a set of parallel cylinders. As known in the art, this allows for robustness of the pile engaging device and for increased force to be applied to the pile, e.g. the monopile.

In practical embodiments, generally as is known from prior art pile guiding devices, the position control circuit comprises:

a position controller, a first position sensor associated with the first cylinder and linked to the position controller, a second position sensor associated with the second cylinder and linked to the position controller, a pump port connectable to a hydraulic pump, a tank port connectable to a tank for hydraulic liquid, a position control valve assembly associated with the first and second cylinder, the pump port, and the tank port, which position control valve assembly is linked to the position controller, the position control valve assembly governing hydraulic liquid flow to and from the first and second cylinders based on position control by the position sensors.

It will be appreciated that, for example, the position control valve assembly may include one or more proportional valves to control the flow of the hydraulic fluid to and from the chambers of the first and second cylinders in order to control the position of the piston rod and thus of the pile engaging member.

In embodiments, the pile guiding device comprises multiple pairs of first and second cylinders, which pairs are arranged on the frame at angular offset positions relative to one another seen in a plan view of the pile guiding device, each pair having a respective hydraulic system with a position control circuit and a sphincter control circuit. For example, the device has two, three or four pairs of first and second hydraulic cylinders.

In embodiments, the frame of the device has a base that is supported by a support assembly that is to be mounted to a vessel, e.g. the hull, and the frame includes one or two movable jaws that are each hinged to the base for opening and closing of the frame about a pile.

The present invention also relates to a method for installation of a pile, e.g. a monopile, the pile comprising a cylindrical section and above said cylindrical section a tapered section that narrows in upward direction, wherein use is made of heave tolerant pile guiding device as discussed herein.

The present invention also relates to a vessel equipped with a heave tolerant pile guiding device according to one or more of the claims for guiding a pile comprising a cylindrical section and above said cylindrical section a tapered section that narrows in upward direction, during installation thereof, e.g. for guiding a monopile.

The present invention also relates to a method for installation of a pile, e.g. a monopile, the pile comprising a cylindrical section and above said cylindrical section a tapered section that narrows in upward direction, wherein use is made of the vessel.

BRIEF DESCRIPTION OF THE DRAWINGS

The invention will now be described with reference to the appended drawing. In the drawing.

DETAILED DESCRIPTION OF EMBODIMENTS

Figure 1:
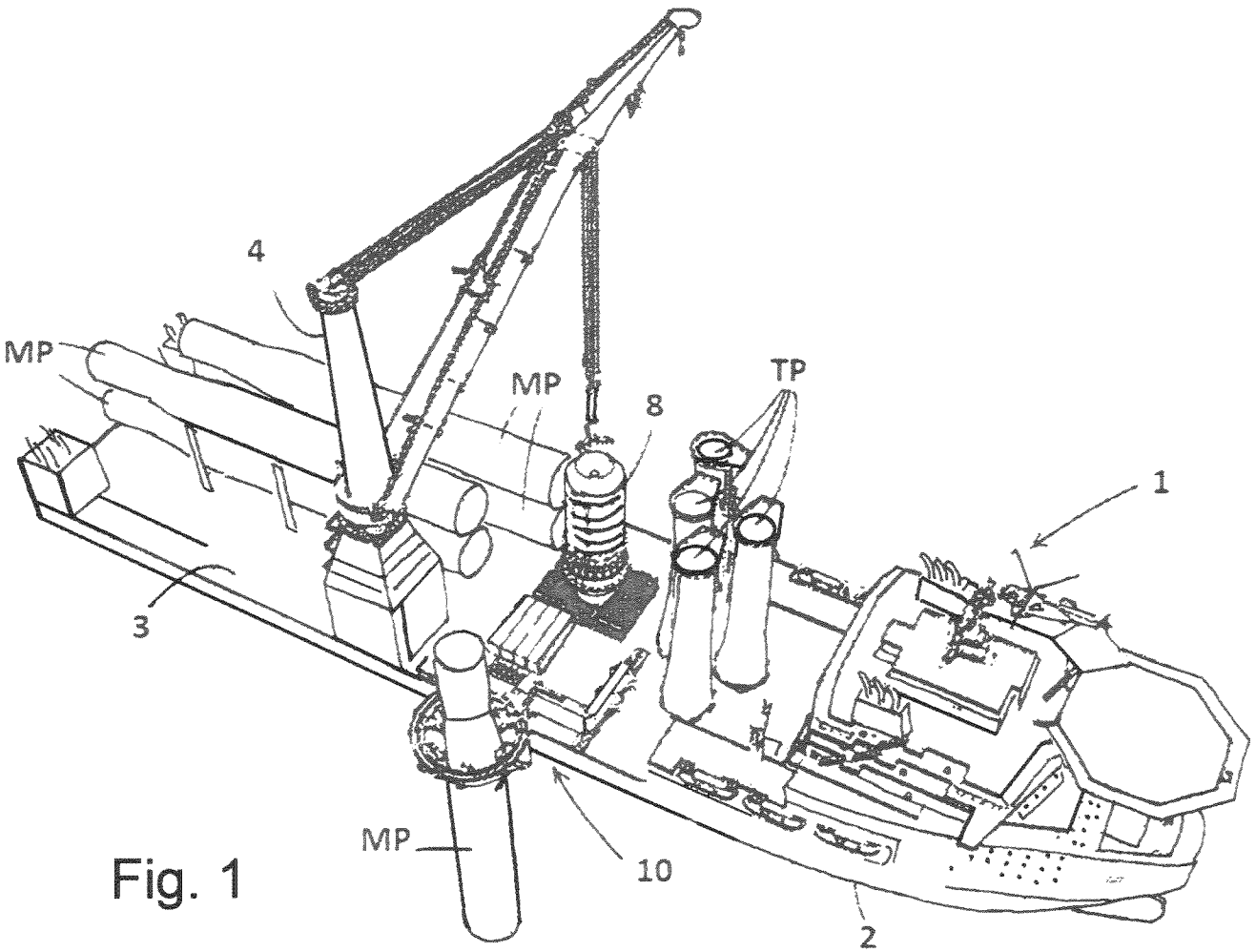
FIG. 1 shows an example of a vessel provided with a pile guiding device during installation of a monopile.
Figure 2:
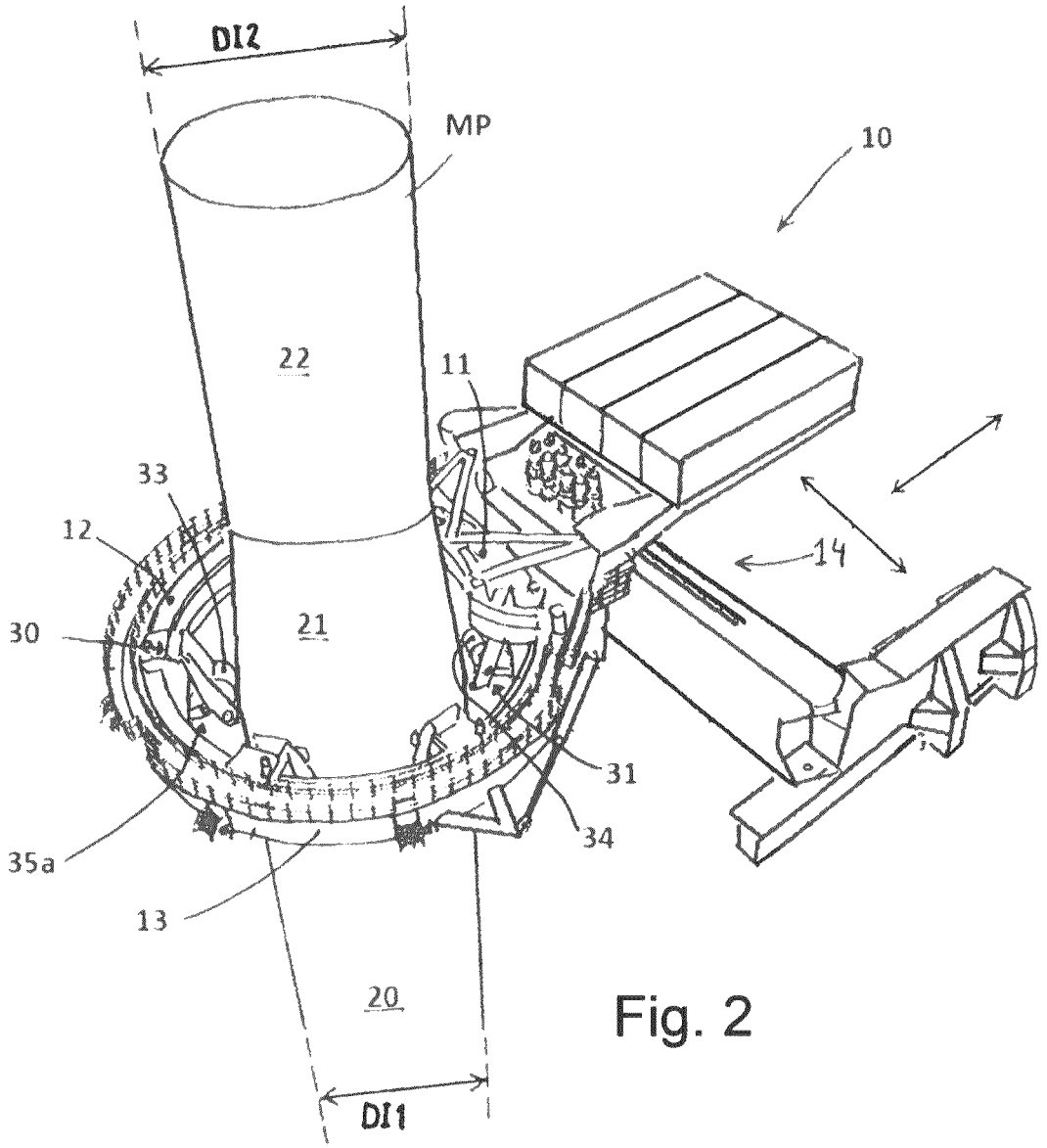
FIG. 2 shows the pile guiding device and the monopile of FIG. 1.

In FIG. 1 a vessel 1 is shown that has a hull 2 with a deck 3. Here, as an example, the vessel is a monohull vessel. The vessel 1 is in floating condition during installation of monopiles MP.

The depicted vessel 1 stores one or more, here multiple, monopiles MP on the deck 3 in a horizontal configuration. Other approaches are also envisaged, e.g. with monopiles MP being stored on a barge that is positioned in proximity of the vessel 1.

The vessel 1 is provided with a crane that is configured to handle a monopile. In this example, the crane 4 is used in the upending process, wherein the monopile is brought from the horizontal orientation to the vertical orientation.

The vessel 1 is equipped with a heave tolerant pile guiding device 10 according to the invention.

FIG. 1 depicts the situation wherein the monopile MP has been landed on the seabed by means of the crane 4. Usually, the monopile will then self-penetrate over a self-penetrating depth into the seabed. The FIG. 1 depicts that the crane has been disconnected from the monopile MP.

The pile guiding device 10 holds the monopile MP vertical. The device 10 is arranged above the waterline.

As shown in FIG. 1 the crane 4 is now used to pick-up a pile driving tool 8, that is subsequently placed on top of the monopile to drive the pile deeper into the seabed.

The FIG. 1 also depicts so-called transition pieces TP. Such a piece TP may, in embodiments, be placed on top of the monopile MP once the pile has been properly driven into the seabed. It then forms a transition to the tower of the wind turbine. In embodiments, there is no transition piece TP between the monopile and the tower of the wind turbine.

The FIG. 1 illustrates that the monopile MP, commonly welded of steel parts, has a lower cylindrical section 20, of which a portion is to be driven into the seabed, and above that cylindrical section 20 a tapered section 21 that narrows in upward direction, e.g. with a second cylindrical section 22 adjoining the narrower top of the tapered section 21. The diameter of the section 20 is greater than of section 22, with the tapered section 21 forming the transition between these cylindrical sections.

FIG. 1 illustrates that the cylindrical section 20 of the monopile, which has landed on the seabed and has self-penetrated into the seabed, is still engaged by the pile guiding device 10 to ensure verticality. The tapered section 21 is somewhat up and will only be engaged once pile driving has progressed.

The pile guiding device 10, shown by way of example, generally has a structure as described in WO2019/125172, to which reference is made. The device 10 comprises:

- a frame, here with a base 11 and two movable jaws 12, 13 that are each hinged to the base for opening and closing the frame, here closing to form a closed annulus,
- a motion compensating support assembly 14, here an X-Y motion compensating support assembly, that supports the frame relative to the hull 2 of the vessel 1 in a manner that allows for compensation of vessel motion in a horizontal plane,
- multiple pairs of first and second pile engaging devices 30, 31 which are arranged on the frame diametrically opposed relative to a center axis.

It is illustrated that each pile engaging device 30, 31 comprises a pile engaging member 33, 34, here a roller, that is configured to engage on an exterior of the pile MP during installation thereof.

Each pile engaging device 30, 31 further comprises a set of two parallel hydraulic cylinders. The cylinders of first device 30 are called first cylinders and are denoted in the schematic illustration of FIG. 3 as first cylinders 35*a*, 35*b*. The cylinders of the second device 31 are called second cylinders and are denoted in the schematic illustration of FIG. 3 as second cylinders 36*a*, 36*b*.

As illustrated, each of the cylinders 35*a,b*, 36*a,b* is embodied as a double acting hydraulic cylinder, and has a cylinder body with a head and a bottom, a piston rod and piston rod assembly, the piston protruding from the head of the cylinder body, a variable volume bottom chamber between the bottom and the piston, and a variable volume head chamber between the head and the piston.

The cylinders are mounted on the frame so as to move the pile engaging devices towards and away from center axis. It is illustrated that extension of the cylinders causes the pile engaging devices to move closer to the center axis and retraction of the piston rod causes the retraction of the pile engaging devices away from the center axis.

The pile guiding device 10 comprises a hydraulic circuit that is associated with the first and second hydraulic cylinders 35*a,b* and 36*a, b*.

Figure 3:
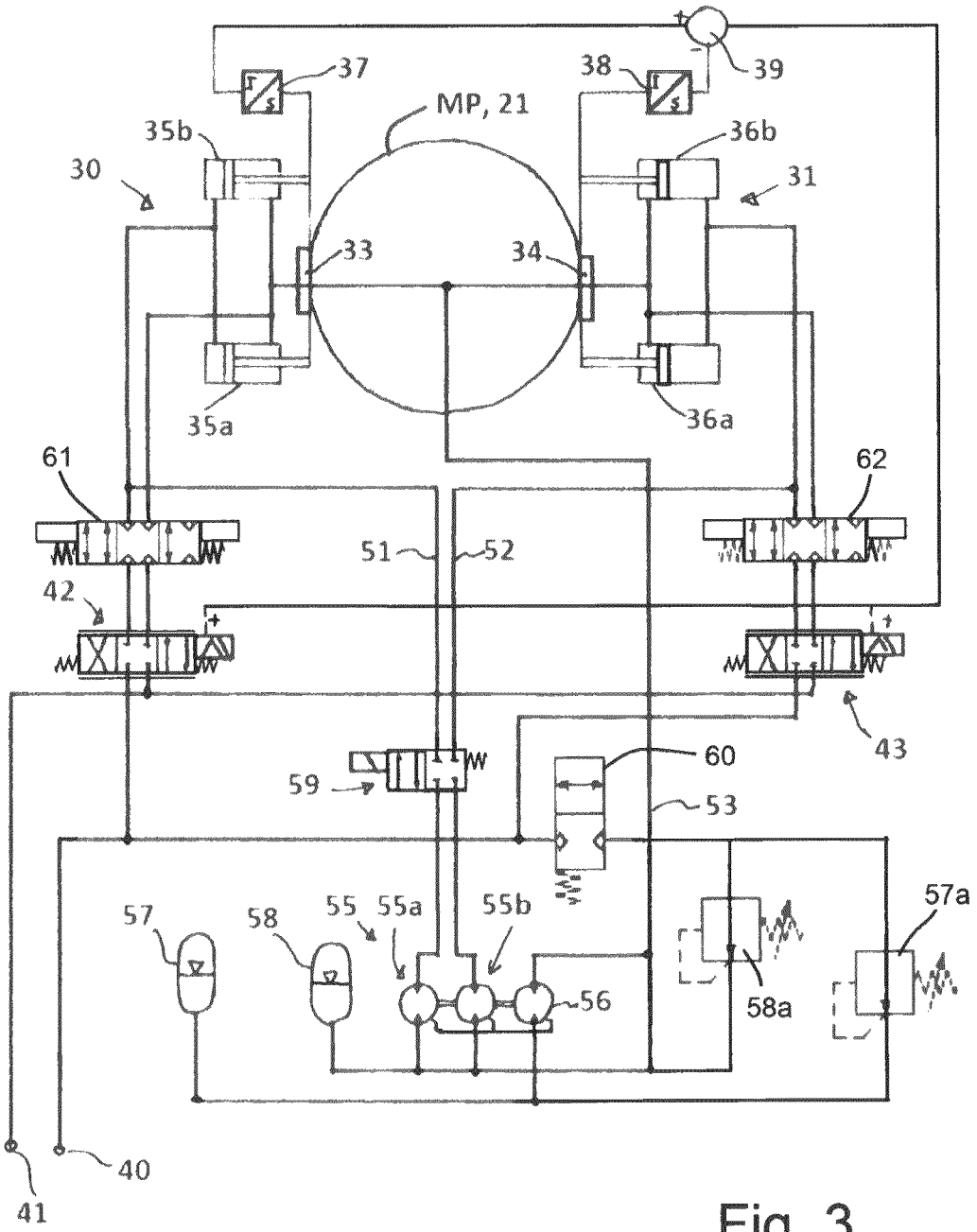
FIG. 3 shows schematically the hydraulic system of the pile guiding device.

The schematic diagram of FIG. 3 shows that the hydraulic system has a pump port 40 that is connected to a hydraulic feed pump, not shown. The feed pump is configured to provide pressurized hydraulic liquid which has been suctioned from a tank, not shown. The system also has a tank port 41 that is connected to the tank.

The hydraulic circuit comprises a position control circuit that is configured to operate the first and second hydraulic cylinders 35*a, b* and 36*a, b* on the basis of position control when the pile engaging members 33, 34 engage on the cylindrical section 21 of the pile MP. As such position control circuits are known in this field, this circuit will only be discussed briefly.

In the FIG. 3 it is illustrated that a position control valve assembly is provided, here (as an example) with two electrically operated proportional flow control valves 42, 43. These valves 42, 43 generally govern the hydraulic liquid flow to and from the first and second cylinders 35*a, b* and 36*a, b* based on position control by position sensors.

It is illustrated that each pile engaging device 30, 31 is provided with a position sensor 37, 38 that is configured to sense the position of the pile engaging device 33, 34, e.g. by sensing piston rod extension and/or some other position representative of the position of the related pile engaging device 33, 34.

The position sensors 37, 38 as well as the position control valves 40, 41 are linked, here as commonly done in electronic manner, to a position controller 39. The controller 39 operates the valves 40, 41 and thereby controls the flow of the hydraulic fluid to and from the chambers of the first and second cylinders 35*a, b*, 36*a, b* in order to control the position of the piston rod and thus of the pile engaging member 33, 34.

The above position control mode realized by the position control circuit is effected when the pile engaging devices 33, 34 engage on the cylindrical section(s) 20, 22 of the monopile MP. This allows to accurately control the position of the monopile within the frame, normally to center the longitudinal axis of the monopile MP on the center axis.

The hydraulic system further comprise a sphincter control circuit that is configured to operate the paired first and second hydraulic cylinders 35*a, b* and 36*a, b* when the pile engaging members 33, 34 engage on the tapered section 21 of the pile.

The sphincter control circuit comprises:

- a first line 51 connected to the bottom chambers of the first cylinders 35*a,b,*
- a second line 52 connected to the bottom chambers of the second cylinders 36*a,b,*
- a third line 53 connected to the both the head chambers of the first cylinders 35*a,b* and the head chambers of the second cylinders 36*a,b*.

The sphincter control circuit further comprises a rotary flow divider 55 having a first pump device 55*a* and a second pump device 55*b* on a common rotary shaft.

The first pump device 55*a* has a port that is connected to the first line 51 and the second pump device 55*b* has a port that is connected to the second line 52. Each of the pump devices 55*a, b* has a further port that is connected to the third line 53.

As preferred, the flow divider 55 further comprises an integrated hydromotor 56. This hydromotor 56 drives the rotary shaft to which the pumps 55*a*, 55*b* are connected. This will be explained in more detail below.

The sphincter control circuit further comprises an accumulator 57, which may also be called main accumulator 57, that is connected to the third line 53. For example, the main accumulator 57 is configured to create a hydraulic liquid pressure of at least 100 bars, e.g. of 200 bars or more. For example, the circuit comprises a pressure control valve 57*a* to set the pressure of the main accumulator 57.

As preferred, the sphincter control circuit further comprises a boost accumulator 58 that is connected to the third line 53 at a location between the flow divider 55 and the hydromotor 56. For example, the boost accumulator is set at 20 bars. For example, the circuit comprises a pressure control valve 58*a* to set the pressure of the boost accumulator 58.

The sphincter control circuit further comprises a valve assembly that is configured to selectively open and close the connection of the rotary flow divider 55 to the first and second lines 51, 52. Here the assembly comprises a two-position flow control valve 59 that is electrically operated. The assembly, in the depicted example, further comprises valves 60, 61, 62 that are operable to selectively activate the sphincter control circuit or the position control circuit.

When the valve 59 is closed and, in this example, the valves 60, 61, 62 are appropriately switched, the cylinders 35*a, b* and 36*a, b* are operated by the position control circuit. No flow through lines 51, 52 is possible between the cylinders 35*a,b*, 36*a, b* and the flow divider 55. As explained, this is done when a cylindrical section 20, 22 is guided by the pile guiding device 10. In this situation, vertical heave motion of the vessel and thus of the device 10, has relatively limited, if any, impact on the pile guiding devices 30, 31 as the rollers, or other pile engaging members, will simply slide up and down along the cylindrical section. Any such limited impact can be absorbed by the operation of the position control circuit, when appropriate. For example, the position control mode allows for centering of the pile MP before the lower end touches the seabed and/or in view of motion compensation, e.g. during pile driving.

For guiding of the tapered section 22 by means of the pile guiding device 10, the valve 59 is opened and, in this example, the valves 60, 61, 62 are appropriately switched, so that the sphincter mode of the hydraulic cylinders 35*a,b* and 36*a, b* is enabled. Generally, the cylinders 35*a,b*, and 36*a,b* are in this mode continuously hydraulically pressurized by the main accumulator 57, thereby constantly urging the pile engaging members 33, 34 against the tapered section 21 of the monopile MP shown in FIG. 3 as a circle. Relative up and down motion of the pile engaging members 33, 34 along the tapered section 21 can be seen as this circle changing in diameter. This pressurization of the cylinders 35*a,b* and 36*a, b* is caused here as both the chambers 35*a*, 36*a*, as well as the chambers 35*b*, 36*b* connect to the main accumulator 57 in the sphincter mode involving appropriate switching of the valves 60, 61, 62.

During downward motion of the pile guiding device relative to the tapered section of the pile, due to heave of the vessel 1, the engaging members 33, 34 are effectively pushed away from the center axis and away from one another. This causes a retraction of the cylinders, wherein the bottom chambers of the cylinders 35*a*, 35*b*, 36*a*, 36*b* each expel hydraulic liquid via the first and second lines 51, 52, respectively. The flow divider 55 causes these flows to be equal flows of expelled hydraulic fluid, so that the motion of the pile engaging members 33, 34 outward will be symmetrical relative to the center axis. These flows emerge at the other ports of the pump devices 55*a, b*, which ports are connected to the third line 53.

As will be understood, some of this expelled hydraulic liquid is fed via the third line 53 to the head chambers of the cylinders 35*a, b* and 36*a, b* to replenish these head chambers. As the effective cross-section of these head chambers is smaller than of the bottom chambers, the main accumulator 57 receives a surplus volume of expelled liquid. The schematic illustration of FIG. 3 shows that this flow passes through the hydromotor 56 before reaching the main accumulator 57, thereby driving the hydromotor 56 which in turn drives the pump devices 55*a, b* of the flow divider 55. This enhances accuracy and operation of the flow divider 55.

During upward motion of the pile guiding device 10 relative to the tapered section 21 of the pile, the main accumulator 57 feeds hydraulic liquid via the hydromotor 56 to the flow divider pumps 55*a, b* and via the lines 51, 52 to the bottom chambers of the cylinders 35*a, b* and 36*a, b*. In this phase, as in the phase of relative downward motion, the flow divider 55 causes an equal flow of the liquid to the paired cylinders 35*a,b* and 36*a, b*, so that a symmetric inward motion is caused of the pile engaging devices 33, 34. In this phase, the head chambers of the cylinders expel hydraulic liquid via the third line 53.

The sphincter solution thus maintains the centered position of the monopile during passing of the tapered section 21 of the pile guiding device.

As will be understood, the sphincter circuit and associated sphincter mode allow for the effective handling of the passage of the tapered section 21 through the pile guiding device, which normally takes place during the pile driving process, even when the floating vessel is subject to heave. Therefore the device is heave tolerant. For example, the sphincter circuit may allow for operation in a sea state that shows greater heave than prior art pile engaging devices, thereby increasing the weather window for installation of piles, in particular of monopiles.

The invention claimed is:

1. A heave tolerant pile guiding device for guiding a pile during installation thereof, the pile comprising a cylindrical section and above said cylindrical section a tapered section that narrows in upward direction, the pile guiding device comprising:

a frame configured to be mounted to a vessel having a hull that is subject to sea-state induced motion during installation of the pile;

at least one pair of first and second pile engaging devices arranged on the frame diametrically opposed relative to a center axis, wherein the first pile engaging device comprises a first pile engaging member configured to engage on an exterior of the pile during installation thereof, and a first hydraulic cylinder configured to move the first pile engaging member radially relative to the center axis, and wherein the second pile engaging device comprises a second pile engaging member configured to engage on the exterior of the pile during installation thereof, and a second hydraulic cylinder configured to move the second pile engaging member radially relative to the center axis; and a hydraulic circuit associated with the pair of first and second hydraulic cylinders, wherein the hydraulic system comprises a position control circuit configured to operate the pair of first and second hydraulic cylinders on the basis of position control, wherein the hydraulic system comprises a sphincter control circuit configured to operate the pair of first and second hydraulic cylinders when the pile engaging members engage on the tapered section of the pile, wherein each of the cylinders comprises a cylinder body with a head and a bottom, a piston and piston rod assembly, the piston protruding from the head of the cylinder body, a variable volume bottom chamber between the bottom and the piston, and a variable volume head chamber between the head and the piston, wherein the sphincter control circuit comprises:

a first line connected to the bottom chamber of the first cylinder;

a second line connected to the bottom chamber of the second cylinder;

a third line connected to both the head chamber of the first cylinder and the head chamber of the second cylinder;

a rotary flow divider having a first pump device and a second pump device on a common rotary shaft, the first pump device connected to the first line and the second pump device connected to the second line, each of the first and second pump devices being connected to the third line;

an accumulator connected to the third line; and a valve assembly configured to selectively open and close a connection of the rotary flow divider to the first and second lines, so that, with said connection closed, the cylinders—are operated by the position control circuit, and so that, with said connection open, a sphincter mode of the hydraulic cylinders is established wherein the first and second hydraulic cylinders are hydraulically pressurized by the accumulator thereby urging the first and second pile engaging members against the tapered section, and so that, during a downward motion of the pile guiding device relative to the tapered section of the pile, the cylinder bottom chambers expel hydraulic liquid via the first and second lines, respectively, the flow divider causing an equal flow of said expelled hydraulic fluid, some of said expelled hydraulic liquid being fed via the third line to the head chambers of the first and second hydraulic cylinders and some being received by the accumulator, and so that, during an upward motion of the pile guiding device relative to the tapered section of the pile, the accumulator feeds hydraulic liquid via the flow divider to the bottom chambers of the first and second hydraulic cylinders, the rotary flow divider causing an equal flow of said feeds of hydraulic fluid, the head chambers expelling hydraulic liquid via said third line.

2. The heave tolerant pile guiding device according to claim 1, wherein the sphincter control circuit comprises a rotary flow divider with an integrated hydromotor configured for driving the rotary shaft, wherein the hydromotor is arranged in the connection between the accumulator and the third line, so that during said downward motion of the pile guiding device relative to the tapered section of the pile, said expelled hydraulic liquid flowing to the accumulator operates the hydromotor and thereby drives the first and second pumps of the rotary flow divider to cause equal flow, and so that, during said upward motion of the pile guiding device relative to the tapered section of the pile, hydraulic liquid is fed from the accumulator via the hydromotor to the rotary flow divider and then in equal flows to the bottom chambers of the first and second hydraulic cylinders, the hydromotor driving the first and second pumps of the flow divider to cause equal flow.

3. The heave tolerant pile guiding device according to claim 2, wherein the sphincter circuit comprises a boost accumulator connected to the third line between the flow divider and the hydromotor.

4. The heave tolerant pile guiding device according to claim 1, wherein each pile engaging device comprises a set of parallel cylinders.

5. The heave tolerant pile guiding device according to claim 1, wherein the position control circuit comprises:

a position controller;

a first position sensor associated with the first cylinder and linked to the position controller;

a second position sensor associated with the second cylinder and linked to the position controller;

a pump port connectable to a hydraulic pump;

a tank port connectable to a tank for hydraulic liquid; and a position control valve assembly associated with the first and second cylinders, the pump port and the tank port, the position control valve assembly being linked to the position controller, the position control valve assembly governing hydraulic liquid flow to and from the first and second cylinders based on position control by the position sensors.

6. The heave tolerant pile guiding device according to claim 1, wherein the pile guiding device comprises multiple pairs of first and second pile engaging devices the pairs being arranged on the frame at angular offset positions relative to one another seen in a plan view of the pile guiding device, each pair having a respective hydraulic system with a position control circuit and a sphincter control circuit.

7. A method for installation of a pile, the pile comprising a cylindrical section and above said cylindrical section a tapered section that narrows in upward direction, wherein use is made of the heave tolerant pile guiding device according to claim 1 for guiding the pile, wherein, in response to the pile engaging members engaging on the tapered section, the hydraulic cylinders are operated in the sphincter mode, wherein the cylinders are hydraulically pressurized by the accumulator and thereby the pile engaging members are urged against the tapered section of the pile, and wherein, during the downward motion of the pile guiding device relative to the tapered section of the pile, the cylinder bottom chambers expel hydraulic liquid via the first and second lines, respectively, the flow divider causing an equal flow of said expelled hydraulic fluid, some of said expelled hydraulic liquid being fed via the third line to the head chambers of the cylinders and some being received by the accumulator, and wherein, during the upward motion of the pile guiding device relative to the tapered section of the pile, the accumulator feeds hydraulic liquid via the flow divider to the bottom chambers of the cylinders, the flow divider causing an equal flow of said feeds of hydraulic fluid, the head chambers expelling hydraulic liquid via said third line.

8. A vessel equipped with the heave tolerant pile guiding device according to claim 1 for guiding a pile comprising the cylindrical section and above said cylindrical section the tapered section that narrows in upward direction, during installation thereof.

* * * * *